US005904206A

United States Patent [19]

Kroetsch

[11] Patent Number: 5,904,206

[45] Date of Patent: May 18, 1999

[54] HEAT EXCHANGER FLOW TUBE WITH IMPROVED HEADER TO TUBE END STRESS RESISTANCE

[75] Inventor: Karl Paul Kroetsch, Williamsville, N.Y.

[73] Assignee: General Motors Corporation, Detroit, Mich.

[21] Appl. No.: 09/030,292

[22] Filed: Feb. 25, 1998

[51] Int. Cl.[6] ..... F28F 9/00

[52] U.S. Cl. ..... 165/173; 165/177; 165/183; 165/906

[58] Field of Search ..... 165/177, 183, 165/906, 173

[56] References Cited

U.S. PATENT DOCUMENTS

| | | | |
|---|---|---|---|
| 3,486,489 | 12/1969 | Huggins | 165/177 X |
| 5,009,262 | 4/1991 | Halstead et al. . | |
| 5,101,890 | 4/1992 | Aoki et al. . | |
| 5,441,106 | 8/1995 | Yukitake | 165/183 |
| 5,555,729 | 9/1996 | Momose et al. | 165/183 X |
| 5,607,012 | 3/1997 | Buchanan et al. | 165/173 |

FOREIGN PATENT DOCUMENTS

| | | | |
|---|---|---|---|
| 3731669 | 4/1989 | Germany | 29/890.049 |
| 61-67531 | 4/1986 | Japan | 29/890.049 |
| 2133525 | 1/1984 | United Kingdom | 165/177 |

*Primary Examiner*—Leonard Leo
*Attorney, Agent, or Firm*—Patrick M. Griffin

[57] ABSTRACT

A novel extruded aluminum condenser flow tube cross section includes a wider central web flanked by a pair of wider, inboard flow passages with rounded corners integral to the wider web. When inserted into the slot of a highly curved header plate, the wider central web corresponds to a central area of higher bending stresses, which are more strongly resisted. The two wider, inboard flow passages help compensate for the potential flow area removed by the wider central web.

1 Claim, 2 Drawing Sheets

HEAT EXCHANGER FLOW TUBE WITH IMPROVED HEADER TO TUBE END STRESS RESISTANCE

TECHNICAL FIELD

This invention relates to extruded heat exchanger flow tubes in general, and specifically to such a tube with a novel cross sectional shape designed to better resist thermal cycling stresses at the interface between the end of the tube and the slotted header into which it is inserted and brazed.

BACKGROUND OF THE INVENTION

With improvements in both braze and tube extrusion technology, it has been possible to improve automotive air conditioning system condensers in several obvious ways. Improved brazing materials and fluxes have allowed manufacturers to consistently achieve leak free tube end to header slot braze joints, in turn allowing for a shift from long, serpentine tube designs to shorter, multi tube flow designs. These are sometimes referred to as "parallel flow" designs, because of the fact that the flow tubes are parallel to each other, but this is somewhat inaccurate, since the flow passes of a serpentine tube are also parallel to each other. "Cross flow" is a more accurate description of the two significant flows involved in the condenser, the refrigerant flowing from side to side (or up and down) through the refrigerant flow tubes, from one header to the other, and the forced outside air running perpendicular thereto, "crossed" with the refrigerant flow. With multiple, shorter tubes, smaller end to end refrigerant pressure drops create the potential for smaller flow passages in thinner tubes. At the same time, improvements in extrusion technology have allowed thinner flow tubes to be integrally extruded, instead of fabricated from thinner pieces, which has been the desired design direction of the industry for at least three decades. Thinner extruded tubes, in turn, have smaller free flow areas, with a higher surface area to internal volume ratio, both of which obviously improve thermal performance.

Since condenser tubes have become thinner and consequently more thermally efficient, it has been possible to make them narrower, as measured in the direction of air flow, giving cores of smaller depth, although the tubes are still far wider in cross section than they are thick. With narrower tubes, cylindrical headers are feasible, since narrower tube ends allow for smaller diameter cylindrical headers, with less volume and weight. Cylindrical headers are also inherently better pressure vessels. Cylindrical headers can be two piece structures, with separate, half cylinder tank bodies and slotted header plates brazed lengthwise thereto, or they can be one piece cylindrical tanks, with one side regularly slotted to receive the equally spaced tube ends. In older, rectangular header designs, the slotted header plate portion of the tank is curved slightly, but not as steeply curved as with a cylindrical tank, in which the cross section of the header plate is basically a semi circle. The braze seam interface between the flat tube end and the header plate is also, therefore, basically a semi circle. In operation, the condenser is subjected to thermal cycling forces, and to bending stresses in the flow tube which are concentrated, in cantilever fashion, at the interface between tube end and curved header. With a flatter header plate, the bending stress is more evenly distributed across the width of the tube, but with a highly curved header plate, it tends to be more highly concentrated in an area at the peak of the curve, centrally of the tube end. Such concentration of stresses can lead to stress fracture, with time, especially with the thinner and less stress resistant flow tubes that can now be successfully extruded.

The cross sectional shape of extruded condenser tubes has been driven by the obvious expedient of maximizing free flow area of the refrigerant. Consequently, by far the most common cross sectional tube configuration has been a simple series of evenly spaced, nearly square and sharp cornered flow passages, separated by regularly spaced internal webs of constant thickness. When a thin tube end is subjected to concentrated stresses, as described above, the sharp internal corners in the square flow passages can act as stress risers that exacerbate the onset of stress fracturing. Round or curved edged passages are not unknown, but are less common, since they inherently pack less refrigerant free flow area and volume into a given tube cross sectional area, for the same reason that round cans occupy less of a shelf's space than do square boxes. Even round flow passages would not solve the cracking problem alone, since there is simply not enough strength in the tube end's area of maximum stress concentration.

There are rare exceptions to the rule of evenly spaced, constant size flow passages and webs in flow tubes, but these tube designs are not directed toward the resistance of stress cracking at the tube end. One example can be seen in published UK Patent Application GB 2 133 525, a 1984 publication which shows an extruded tube cross section with square cornered flow passages of progressively decreasing width, moving in the direction of air flow across the tube. This is directed toward increased corrosion resistance, putting thicker outer wall sections where the corrosion is worse. Even there, the internal web thicknesses are fairly regular. A coassigned patent U.S. Pat. No. 5,186,246 discloses a combined radiator and condenser with an integrally extruded double flow tube which, if a cross section were taken not through the tube end, would have the appearance of a single tube with unevenly spaced flow passages of different size. This appearance flows from the fact that the tube is two sided, or two tubes joined along their inner edges, in effect. The integral double tube has a series of smaller condenser flow passages on one side, and a single large radiator passage on the other side, separated by a wider central area having no flow passages. The central area joining the two sides of the single tube is undesirable in terms of thermal efficiency, however, since it promotes cross heat flow between the condenser and the radiator, and is simply an inevitable result of extruding an integral, two sided tube. Alternate embodiments provide two totally separate tubes. Moreover, the central area in the integral double tube embodiment does nothing to resist stress cracking at the tube end, since it is has to be notched and cut entirely away in order to allow the tube end to be inserted into the dual header tank without interference.

In short, the standard for an extruded condenser tube is a tube cross section with regularly spaced, uniform sized, square or rectangular flow passages separated by regularly spaced, uniformly thin internal webs. Thick internal webs would remove too much refrigerant free flow area, and are therefore extruded no thicker than the simple requirement for tube burst resistance required.

SUMMARY OF THE INVENTION

The subject invention provides an integrally extruded flow tube for use in a cross flow condenser having cylindrical headers which has improved tube end stress resistance. The tube, in cross section, has two series of square cornered flow passages, defined by standard width internal webs, spaced evenly to either side of a substantially wider central web. In addition, the four corners of the two inboard flow passages that border and are integral to the wider central web are rounded off.

Consequently, when the tube ends are inserted in the slots of the cylindrical header plate, the wider central web is coincident to the centralized area of higher stress concentration. The extra width of the central web alone is much more resistant to stress fracturing. That resistance is assisted by the rounding off of those flow passage corners integral to it, which removes the stress risers associated with standard, sharp cornered flow passages. In effect, an integral extruded tube of standard exterior shape and size, manufactured and assembled by standard methods, provides a greatly improved resistance to fracturing with only some diminution in internal total flow capacity and thermal performance.

BRIEF DESCRIPTION OF THE DRAWINGS

These and other features of the invention will appear from the following written description, and from the drawings, in which.

DESCRIPTION OF THE PREFERRED EMBODIMENT

Figure 1:
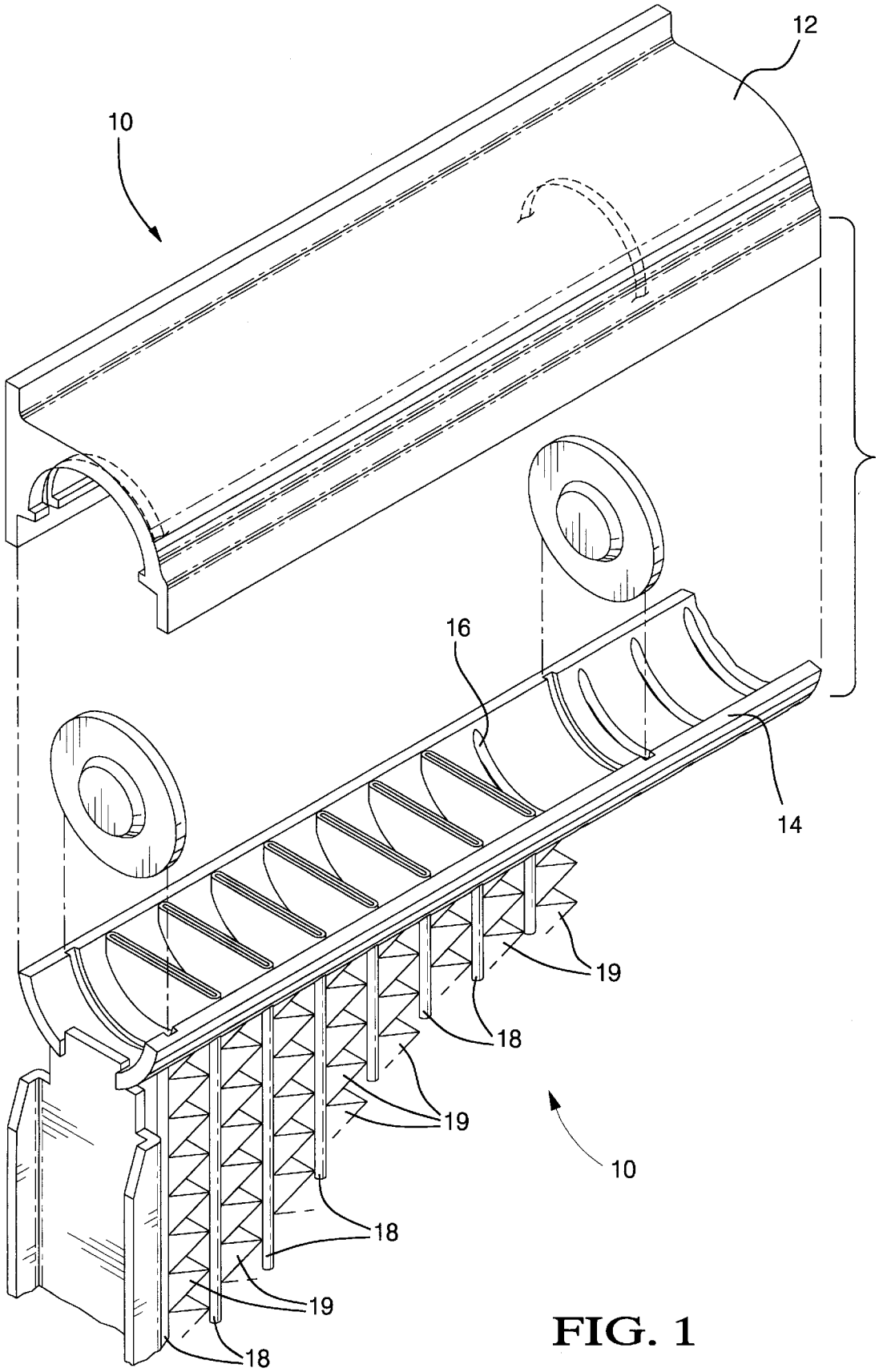
FIG. 1 is a perspective view of the general type of condenser incorporating the new flow tube cross section of the invention, showing the inside of the semi cylindrical, slotted header plate, with several tube ends inserted therethrough.

Referring first to FIG. 1, a cross flow condenser indicated generally at 10 is an all aluminum alloy design, with a cylindrical header comprised of a half cylinder tank 12 and a matching half cylinder header plate 14. Tank 12 is a length of continuous extrusion, while header plate 14 is a separate stamped plate. Header plate 14 has a regularly spaced series of tube slots 16, each of which is a partial segment of a circle or arc, given the semi cylindrical shape of the header plate 14. Each end of a matching plurality of straight flow tubes, indicated generally at 18, is inserted closely through an opposed pair of header plate slots 16, in a conventional core stacking machine. Conventional corrugated air fins 19 are stacked between each parallel pair of adjacent flow tubes 18. The entire stacked core is then run through a braze oven, where a layer of braze material clad onto the outer surface of the header plate 14 melts and is drawn by capillary action into the close fitting interface between the outer surface of the ends of the flow tubes 18 and inner ends of the header plate slots 16, ultimately solidifying to form leak free braze joints.

Figure 4:
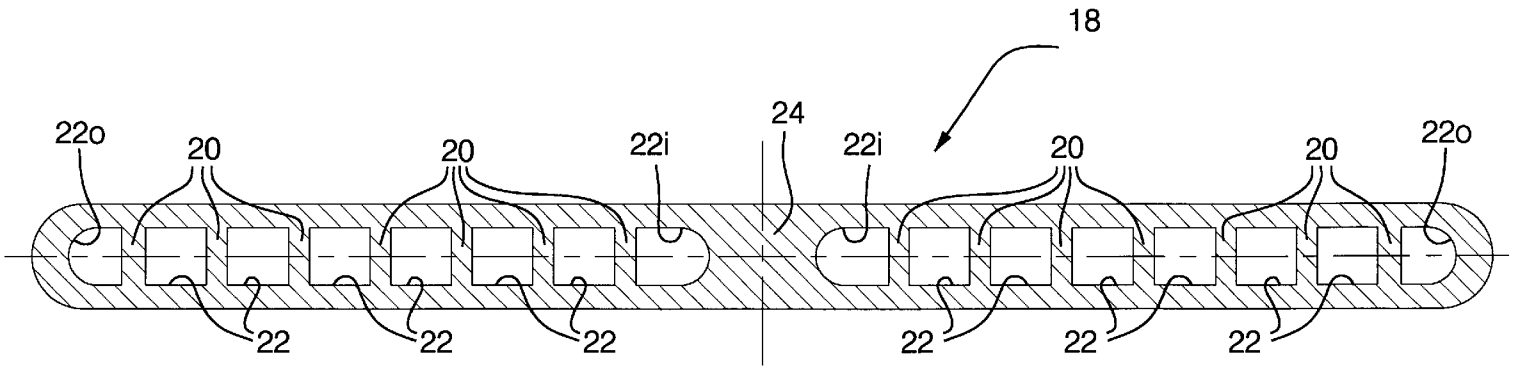
FIG. 4 is a cross section taken near the tube end along the line 4—4 of FIG. 3.

Referring next to FIG. 4, each flow tube 18 has several conventional features. It is an equal length cut section of continuous, integral aluminum extrusion. As such, an axial view of either end of tube 18, as well as a cross section taken anywhere along its length, has the same apparent shape. That cross sectional shape is comprised of a stadium shaped outer surface, with flat upper and lower exterior surfaces, each of which has a total width W, and a significantly smaller surface to surface thickness T. As cores become more compact and efficient, W can shrink, but tube thicknesses have shrunk, as well, so that T will typically always be much less than W. The tube length, of course, will depend on the grill size of the vehicle in question, and will be a high multiple of W. A plurality of regularly spaced, internal webs 20 running the length of tube 18 and perpendicular to the upper and lower tube surfaces, provide internal burst strength. Each of the fourteen internal webs 20 has a width Ww that is just sufficient to provide tube burst resistance, so as to leave as much open flow area as possible within the tube interior. The internal webs 20 divide the tube interior into sixteen total flow passages, eight on each side, most of which (twelve out of fourteen), numbered at 22, have substantially equal widths. The flow passages 22, as is typical, are rectangular, and nearly square, with a width that only slightly exceeds their thickness. The nearly square shape of passages 22 provides high internal burst resistance. As is also typical, the equal width flow passages 22 have four square internal corners. This maximizes the refrigerant flow area (and volume or refrigerant) within the tube 18, as noted above, for the same reason that square boxes on a shelf occupy more of the total available shelf area than do round cans. The two outboard passages **22*o* are naturally rounded on the outside corners, because of the fact that the edges of tube 18 are also rounded to reduce air flow resistance, and this is true of conventional tubes. The outboard passages 22*o*** are also slightly narrower, because the tube edges are thickened for strength.

Still referring to FIG. 4, the cross section of tube 18 differs from the conventional in two important respects. A central web 24 has a significantly greater width Wc, approximately four to five times as wide as an internal web 20, consequently removing one or two flow passages 22 that could otherwise be provided within the given tube width W. In addition, the two inboard flow passages **22*i*, which directly border the central web 24, are rounded into a semi circular shape on the corners thereof that are integral with the central web 24. Also, the inboard flow passages 22*i* can be made, and are made, wider than the other flow passages 22. The inboard passages 22*i* can be made wider, since the adjacent wider central web 24 is wider and stronger, and provides more burst resistance than the thinner webs 20. Making the inboard two passages 22*i* wider, in turn, adds back some of the potential refrigerant flow area removed by the wider central web 24. The reason for the differing cross sectional shape at the center of tube 18** can be better understood after describing the forces to which the condenser core is subject in operation.

Figure 3:
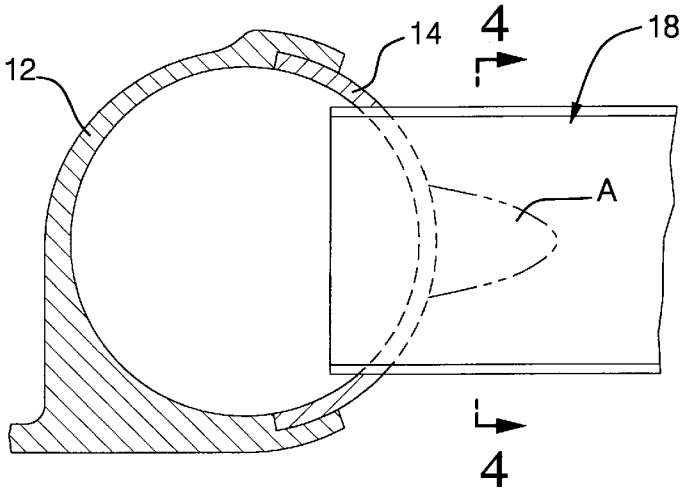
FIG. 3 is a schematic representation of a single tube viewed along the axis of the header, showing the centralized area of stress concentration at the interface between the tube end and the header plate.
Figure 2:
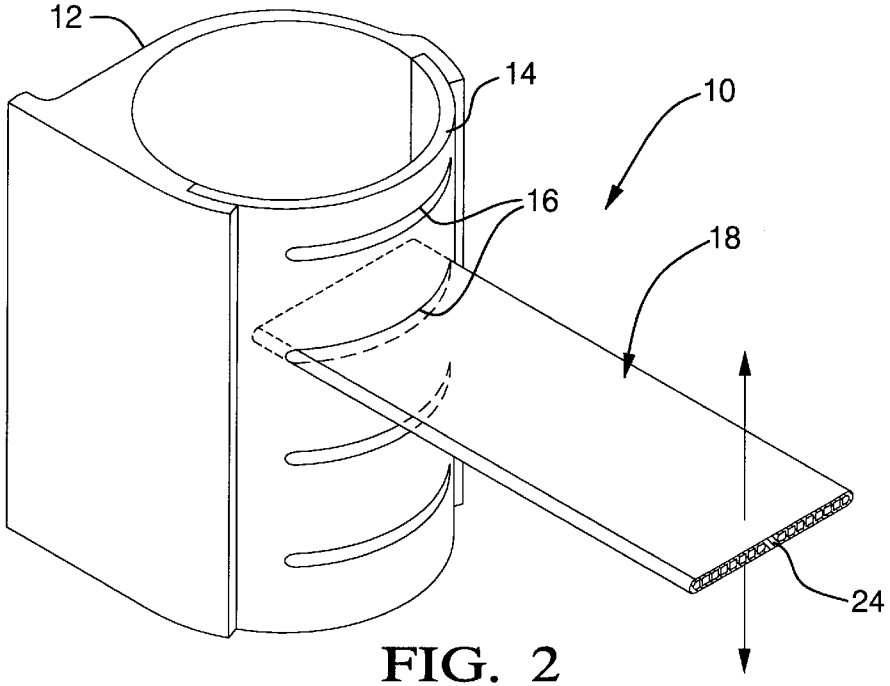
FIG. 2 is a schematic representation of a single flow tube, cantilevered from the slotted header, showing the forces acting on the tube.

Referring next to FIGS. 2 and 3, any condenser core is subject the thermal expansion and contraction of all of its components. These forces are particularly concentrated at the ends of the long, thin flow tubes 18, at their interface with the header plate slots 16. As seen in FIG. 2, forces act to bend the flow tube 18 back and forth in cantilever fashion, like a diving board hinged at its end. While some of the bending stress would be expected to concentrated at the tube edges, testing and experience has shown that, at least in conventionally shaped thin tubes, most stress failure and cracking tends to appear at a central area roughly outlined at "A," near the peak of curvature of the header plate 14. The curved shape that increases pressure resistance in the header can negatively affect the bending resistance of the tube end. In addition, thermal expansion and contraction of the tube 18 across its width W is concentrated in the area A. Furthermore, thermal expansion and contraction of the tube 18 across its thickness T is concentrated centrally. In addition, a header plate could be even more highly or steeply curved, in cross section, than the semi circular header plate 14, having a half elliptical or parabolic shape. Such a sharply pointed peak of curvature would even further concentrate stresses at the center of the width of tube 18.

Referring again to FIG. 4, the wider central web 24 is strategically placed within the central stress area A, and its greater width provides more metal to resist bending forces and stresses of all sorts. This is far stronger than a tube with a central flow passage, and stronger than a tube with a central web of conventional width. In addition, the rounding of the corners of the inboard flow passages 22*i* that border the wider central web 24 removes sharp cornered stress risers that could otherwise promote metal cracking. Similar considerations apply to the outboard passages 22*o*, and to the thicker tube edges, although the greatest problem has been found to be at the tube center, as noted above. Testing has shown a marked improvement in tube structural performance and life. The tube is still manufactured of conventional material, by conventional extrusion tools, and with typical outer dimensions. The new cross sectional shape has not significantly affected the thermal performance, because only a few flow passages are rounded off, and the larger flow passage width at 22*i* compensates for the wider central web 24.

Variations in the disclosed embodiment could be made. As noted above, the header plate 14 could be even more steeply curved, almost pointed. This would exacerbate the concentration of bending stresses in the area A, but the central web 24 could be widened accordingly. The inboard flow passages 22*i* need not be made wider than the other passages 22, but doing so does compensate for the refrigerant free flow area removed by the wider central web 24. So long as the central web 24 was sufficiently wider than the other webs 20 to provide enough extra strength and stress resistance, the inboard flow passages 22*i* would also not have to be rounded off on their bordering corners. Doing so removes very little refrigerant free flow area, however, and removing the sharp corners does promote overall structural performance by removing the stress risers. With very thin tubes, making all of the flow passages completely circular, not just the inboard and outboard ones, and removing all sharp corners, becomes potentially viable. A circular flow passage is inherently even more pressure resistant, just as a round tank is a stronger pressure resistant vessel that a square cornered tank of comparable size. Furthermore, as tube thickness T shrinks, and flow passage cross sectional area along with it, refrigerant pressure drop end to end across the length of tube 18 becomes more of a factor, and round flow passages without sharp corners have lower resistance to internal fluid flow. Therefore, it will be understood that it is not intended to limit the invention to just the embodiment disclosed.

I claim:

1. In a cross flow, tube type heat exchanger having a plurality of flattened flow tubes extending generally perpendicularly to a pair of headers that are curved in a cross section taken parallel to said tubes, the ends of which tubes are inserted through close fitting slots in said headers, said heat exchanger also being subject to thermal cycling forces that impose bending stresses on said tube ends where they enter said slots, said stresses being substantially concentrated near the center of said tube ends in an area proximate to the peak of curvature of said headers, an improved cross sectional shape for said tube, comprising, a plurality of internal webs running an entire length of said tube and defining a plurality of flow passages therebetween, with one of said webs constituting a central web of greater width than the remaining webs, which have a substantially uniform, smaller width, and with the two flow passages bordering said central web having a greater width than the other flow passages and having cross sectional shape which, in the area integral with said central web, is curved, so that the juncture of said central web with said two flow passages is substantially free of stress risers and so that the refrigerant free flow area removed by said wider central web is compensated by the greater width of said bordering flow passages, whereby, at said tube ends, said central web is coincident with said area of stress concentration, and stresses in said tube end are better resisted by virtue of said central web's greater width and lack of stress risers.

* * * * *